United States Patent [19]

Hori

[11] 4,367,035

[45] Jan. 4, 1983

[54] LIQUID DEVELOPER ELECTROSTATIC COPIER FOR SHIPBOARD USE

[75] Inventor: Tatsu Hori, Los Altos, Calif.

[73] Assignee: Savin Corporation, Valhalla, N.Y.

[21] Appl. No.: 142,146

[22] Filed: Apr. 21, 1980

[51] Int. Cl.[3] ..... G03G 15/10

[52] U.S. Cl. ..... 355/10; 354/324; 354/331; 355/3 DR; 355/27

[58] Field of Search ..... 355/3 R, 3 DR, 10, 27, 355/15; 354/324, 327, 331, 333, 336

[56] References Cited

U.S. PATENT DOCUMENTS

| | | | |
|---|---|---|---|
| 2,752,833 | 7/1956 | Jacob | 355/4 X |
| 3,759,220 | 9/1973 | Saito et al. | 355/15 X |
| 3,828,360 | 8/1974 | Dicus | 354/331 X |
| 4,018,524 | 4/1977 | Tani et al. | 355/10 |
| 4,044,718 | 8/1977 | Blake | 355/10 X |
| 4,179,210 | 12/1979 | Bestenreiner et al. | 355/10 |
| 4,202,619 | 5/1980 | Plumadore | 355/10 X |

*Primary Examiner*—Fred L. Braun
*Attorney, Agent, or Firm*—Shenier & O'Connor

[57] ABSTRACT

A copier employing liquid developer in which the lower portion of a deep well in the liquid carrier extends downwardly into the space between a pair of shock absorbing machine base plate mounts to receive the supply of liquid developer for the machine. A motor housing in the upper portion of the well extends downwardly to approximately the upper level of liquid in the lower portion of the well when it contains a full charge of liquid. Each of a cleaning fluid supply motor and a developer electrode supply motor in the housing has a shaft which extends downwardly to a respective pump disposed in the liquid supply to drive the pumps respectively to supply liquid to the cleaning station and to the developer station. A splash plate extending over the top of the well prevents the escape of liquid from the well even with the machine at an appreciable angle from the horizontal. Shields are provided at various locations on the machine to prevent the accidental escape of liquid. Baffles inhibit free movement of liquid in the tank. Filler material in a developer applicator gap extending in the direction of the drum axis controls the flow of developer in the gap to facilitate copying when the machine tilts around an axis perpendicular to the drum axis.

9 Claims, 11 Drawing Figures

LIQUID DEVELOPER ELECTROSTATIC COPIER FOR SHIPBOARD USE

FIELD OF THE INVENTION

The invention relates to the field of electrostatic copiers and, more particularly, to an electrostatic copier using a liquid developer which is especially adapted for use on shipboard.

BACKGROUND OF THE INVENTION

There are known in the art electrostatic copiers which employ as a developer a suspension of toner particles in a carrier liquid, as distinguished from those electrostatic copiers which use a dry developer which may, for example, be a mixture of toner particles and particles of magnetic material. Copiers of the liquid developer type are superior to the dry developer copiers in that their operation generally is more trouble free and, consequently, they require less frequent servicing. They do not involve the use of powdery material which may become entrained in a stream of air and be deposited in places other than image areas to be developed.

While, for the reasons pointed out hereinabove, liquid developer copiers are in many respects superior to dry developer copiers, liquid developer copiers of the prior art are not adapted for use in environments such as on shipboard where movement of the vessel may cause the liquid to spill or, at least, to run over parts of the machine which it is generally desirable to keep free of developer liquid. In addition proper copying cannot be achieved under relatively severe tilting of the copier.

SUMMARY OF THE INVENTION

One object of my invention is to provide a liquid developer electrostatic copier which is especially adapted for shipboard use.

Another object of my invention is to provide a liquid developer electrostatic copier from which liquid will not spill even when the copier is tilted at a relatively large angle to the horizontal.

Still another object of my invention is to provide a liquid developer electrostatic copier in which the possibilities of damage to the parts and of spilling of liquid in response to shocks is minimized.

Yet another object of my invention is to provide a liquid developer electrostatic copier capable of making copies under relatively severe conditions of tilt.

Other and further objects of my invention will appear from the following description.

In general, my invention relates to a copier employing liquid developer for shipboard use in which the lower portion of a deep well in the liquid carrier extends downwardly into the space between a pair of shock absorbing machine base plate mounts to receive the normal supply of liquid developer for the machine. A motor housing in the upper portion of the well extends downwardly to approximately the upper level of liquid in the lower portion of the wall when it contains a full charge of liquid. Each of a cleaning fluid supply motor and a developer electrode supply motor in the housing has a shaft which extends downwardly toward a respective pump disposed in the liquid supply to drive the pumps to supply liquid respectively to the cleaning station of the machine and to the developer station in the machine. A splash plate extending over the top of the tank around the periphery thereof, in addition to a gasketed seal cover plate for the tank, prevents the escape of liquid from the tank, even with the machine at an appreciable angle to the horizontal. Shields are provided at various locations on the machine to prevent accidental escape of liquid. Baffles inhibit free movement of the liquid in the tank. The liquid level in the tank is limited so that at the maximum machine tilt angle, the liquid does not overflow thru the smaller openings in the proximity of the center of the cover plate. The flow of developer in the applicator assembly slit is so controlled as to permit copying under relatively severe conditions of tilt.

BRIEF DESCRIPTION OF THE DRAWINGS

In the accompanying drawings to which reference is made in the instant specification and which are to be read in conjunction therewith and in which like reference characters are used to indicate like parts in the various views:

FIG. 3 is a top plan of the liquid supply system of my liquid developer electrostatic copier for shipboard use.

DESCRIPTION OF THE PREFERRED EMBODIMENT

Figure 1:
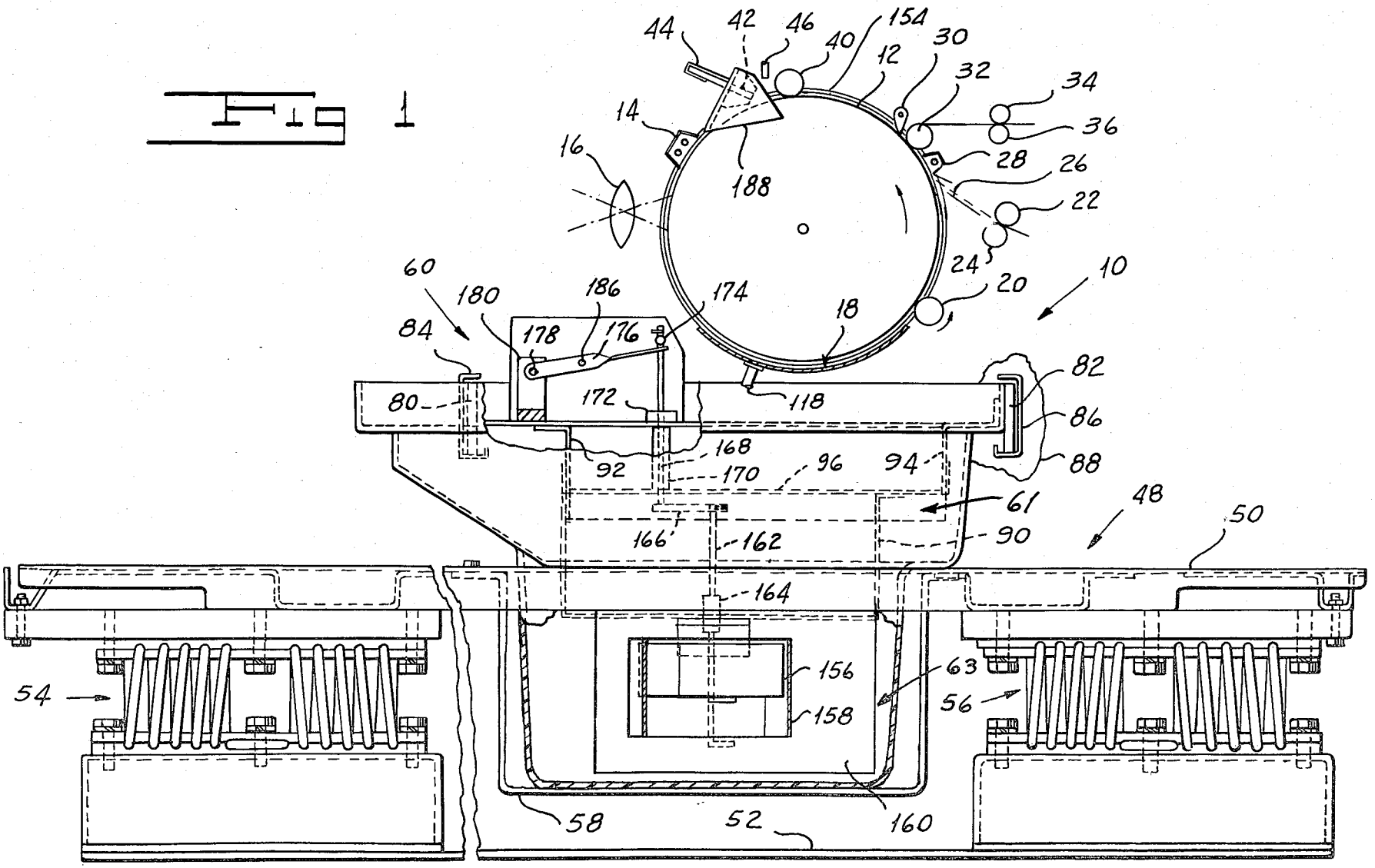
FIG. 1 is a partially schematic front elevation of my liquid developer electrostatic copier for shipboard use with parts broken away and with other parts shown in section.

Referring now to FIG. 1 of the drawings, my liquid developer electrostatic copier machine for shipboard use indicated generally by the reference character 10 includes a drum 12, a charging corona 14 and an exposure station indicated schematically by the lens 16 at which the surface of drum 12 which has been charged by corona 14 is exposed to an image of the original to be copied. Drum 12 is driven to move the surface thereof successively past these stations to cause a latent image of an original to be formed thereon in a manner known to the art. After leaving the exposure station, the latent image moves past a developer applicator assembly, indicated generally by the reference character 18 which is supplied with liquid developer in a manner to be described to develop the latent image. Upon leaving the developer station, the drum surface moves past a "reverse roller" which removes excessive liquid from the surface. This device is more fully shown in U.S. Pat. No. 3,907,423.

A pair of feed rolls 22 and 24 feed a sheet of material such as paper onto which the developed image is to be transferred to a "ready" position. The image from which the excess developer liquid has been removed approaches the point at which the image is to be transferred to the copy material. The copy material is guided by one or more guides 26 to meet tangentially with the drum and is caused to adhere momentarily to the drum by the effect of the transfer corona 28 which is energized. The transfer corona also causes the toner particles to move from the surface of the drum 12 to the sheet of copy material. After the transfer operation, the leading edge of the sheet is picked off the drum by any suitable means, such for examples as by a claw 30 which moves the sheet back around a turn roller 32 toward a pair of delivery rollers 34 and 36, which carry the copy to a location at which it is delivered to the user.

After the copy has been picked off the drum, the surface moves to a cleaning station at which a cleaning roll 40 and a cleaning blade 42 supported in a bracket 44 act on the surface of the drum to remove any excess toner remaining thereon. To facilitate this operation, liquid developer is fed into the region between the blade 42 and the roller 40 through a pipe 46. The details of such a cleaning station are more fully shown in U.S. Pat. No. 4,032,229.

The base indicated generally by the reference character 48 of my electrostatic copier intended for shipboard use includes a base plate 50 which is supported on a shock-mounted frame 52 by respective left-hand and right-hand shock absorbing mounts 54 and 56. These mounts assist in preventing damage and spilling in response to shocks incident to the firing of guns and the like where the copier is installed on a naval vessel.

Figure 2:
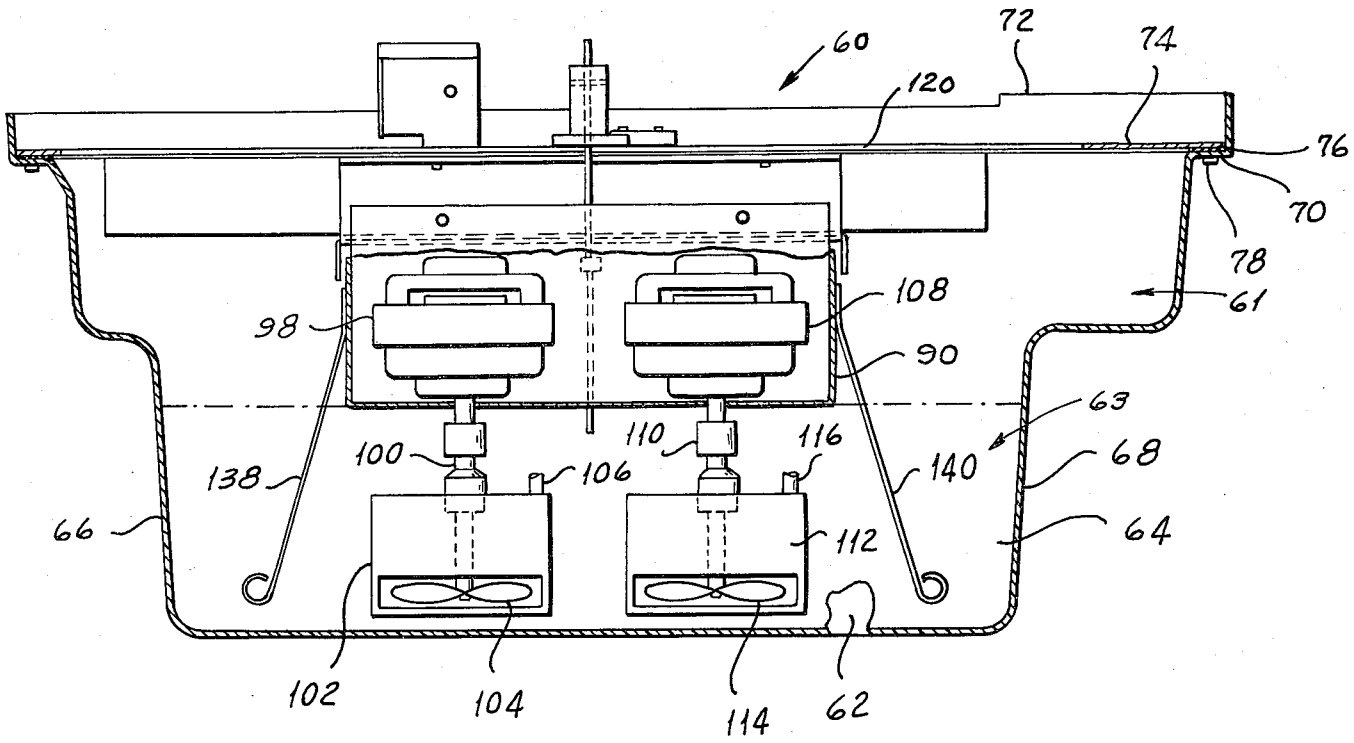
FIG. 2 is a section of the liquid supply system of my liquid developer electrostatic copier for shipboard use.

Referring now to FIGS. 1 to 3, the base plate 50 carries a downwardly extending generally U-shaped bracket 58 which supports the liquid developer supply tank indicated generally by the reference character 60. Tank 60 includes a back wall 66, a front wall 68 and respective side walls 62 and 64. I so configure the tank 60 as to form an upper tank portion 61 located above the base plate and a well portion 63 extending downwardly from the upper portion 61 to a location below base plate 50. The construction, moreover, is such that when the machine carries a full charge of developer liquid it is contained in well 63 and the surface thereof is at the location of the dot-dash line in FIG. 2.

I form the upper end of the tank 60 with a peripheral horizontal flange 70 surrounded by a wall 72. A splash plate 74 supported on a gasket 76 resting on the flange 70 is secured in position by any suitable means, such for example as by screws 78. The supply tank 60 is provided with a pair of guides 80 and 82 running fore and aft of the machine and adapted to be received in respective brackets 84 and 85 carried by the machine wall 88.

Brackets 92 and 94 secured to the underside of the splash plate 74 by any suitable means support the cover 96 of a motor housing 90. Housing 90 carries the cleaning station liquid supply motor 98 having a shaft 100 which extends through the bottom of the housing 90 to the pump 102 having an impeller 104 which, when the shaft 100 is driven, supplies fluid to an outlet pipe 106 leading to pipe 46.

Housing 90 also receives the liquid developer supply motor 108 having a shaft 110 which extends downwardly through the bottom of the housing to the developer supply pump 112 having an impeller 114 which, when shaft 110 is driven, supplies developer liquid to an outlet pipe 116 leading to the inlet 118 to the developer applicator assembly.

I form the splash plate 74 with a generally rectangular opening 120 disposed below the developer applicator electrode 18. A second opening 121 in the splash plate permits introduction of toner concentrate into the system in a manner which will not be described in detail since it does not per se form part of my invention.

Figure 5:
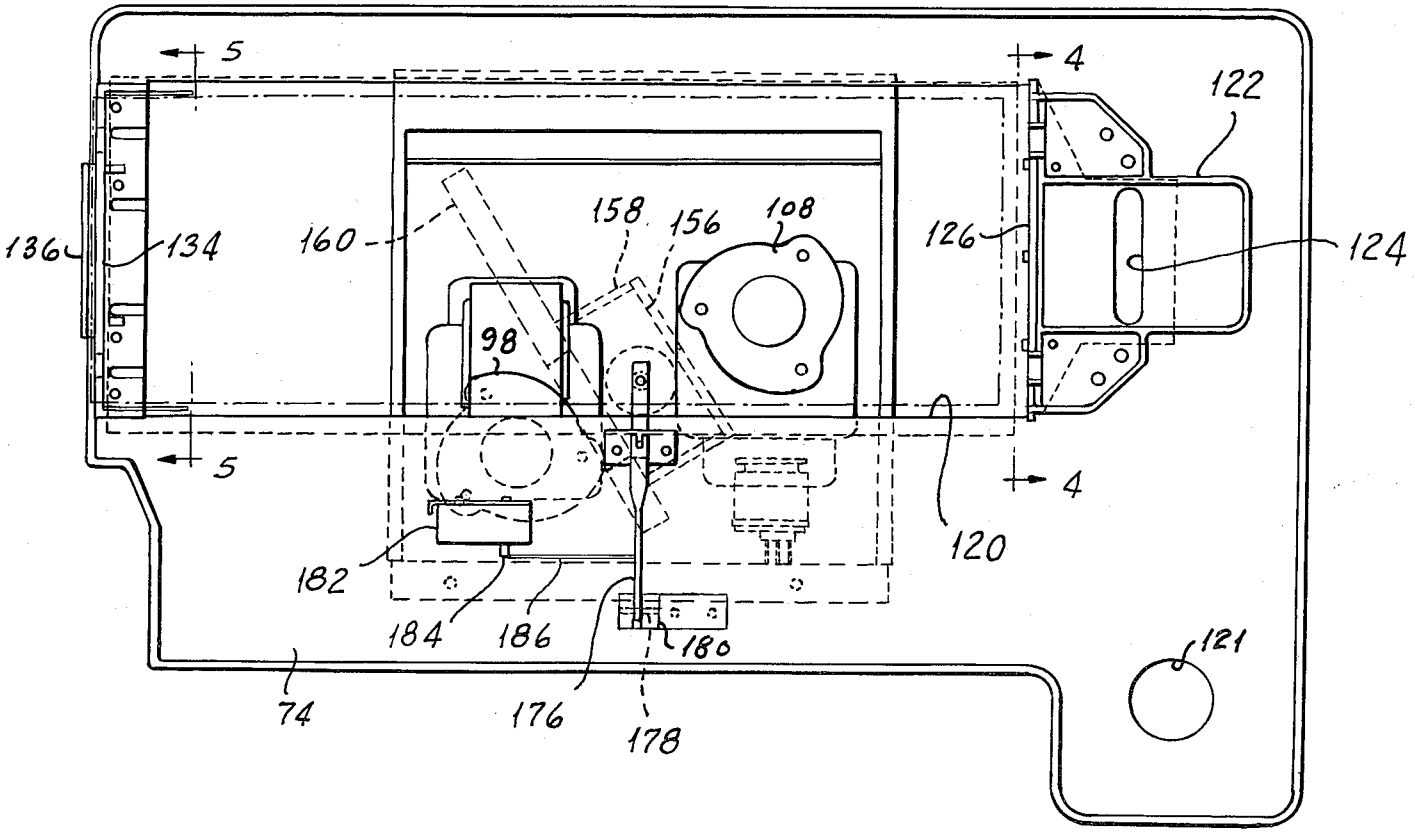
FIG. 5 is a fragmentary section of the liquid supply system of my liquid developer electrostatic copier taken along the line 5—5 of FIG. 3 and drawn on an enlarged scale.
Figure 4:
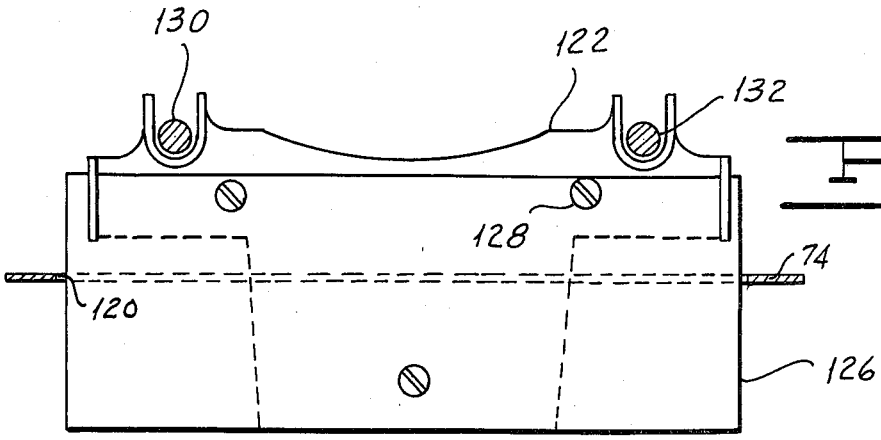
FIG. 4 is a section of the liquid supply system of my liquid developer electrostatic copier taken along the line 4—4 of FIG. 3 and drawn on an enlarged scale.
Figure 5:
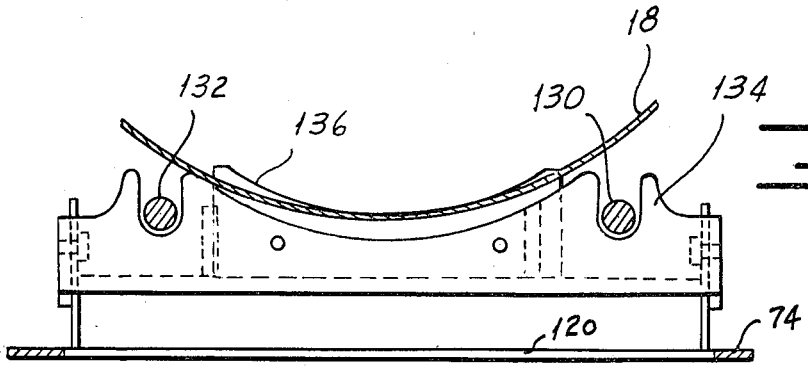

Referring now to FIGS. 3 to 5, my machine includes a diluent inlet and an electrode assembly support bracket 122 provided with a funnel opening 124 through which diluent can be introduced into the tank 60. In my arrangement, I secure a plate 126 to the member 122 by any suitable means, such for example as screws 128 and by the use of a suitable adhesive, such as epoxy, over the common area of plate 126 and the face of element 122, as viewed in FIG. 4. Plate 126 extends downwardly into the upper portion 61 of the tank 60 adjacent to opening 124 to prevent liquid developer from splashing upwardly out of the opening 124.

The electrode and applicator assembly 18 of the machine to be described in detail hereinbelow includes a pair of support rods 130 and 132 extending fore and aft of the machine from the front bracket element 122 rearwardly toward a rear bracket 134. I secure a seal 136 to the rear bracket 134 to ensure that any liquid developer at the back of the machine does not run off the rear edge of the assembly 18 over the region of effective application of the assembly 18. In FIG. 3, I have indicated the position of the development electrode relative to the opening 120 by the dot-dash line and have indicated the relative position of the drum 12 by broken lines.

Referring again to FIG. 2, I secure respective baffles 138 and 140 to the sides of the tank 90. These baffles extend downwardly into the supply developer liquid in the wall 63 to inhibit free movement of the liquid when the machine moves out of the horizontal or is subjected to sudden shocks as a result of violent pitching or the firing of guns. The tips of these extensions also support the outlet tube, one from each pump, for stirring the liquid toner solution.

Figure 8:
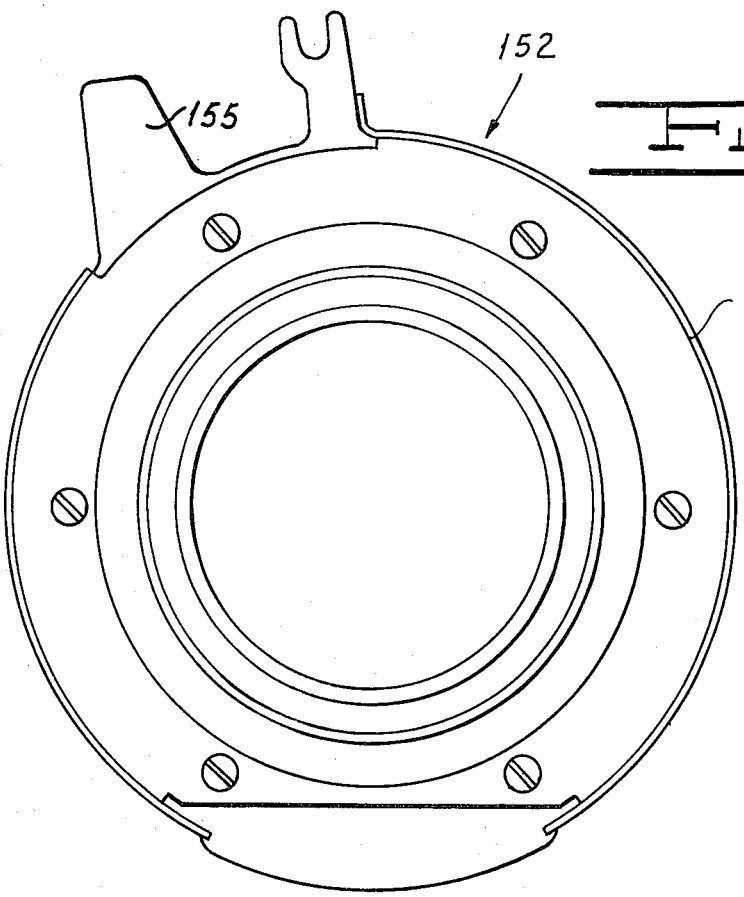
FIG. 8 is an elevation of the other drum end plate of my liquid developer electrostatic copier for shipboard use taken along the line 8—8 of FIG. 6.
Figure 6:
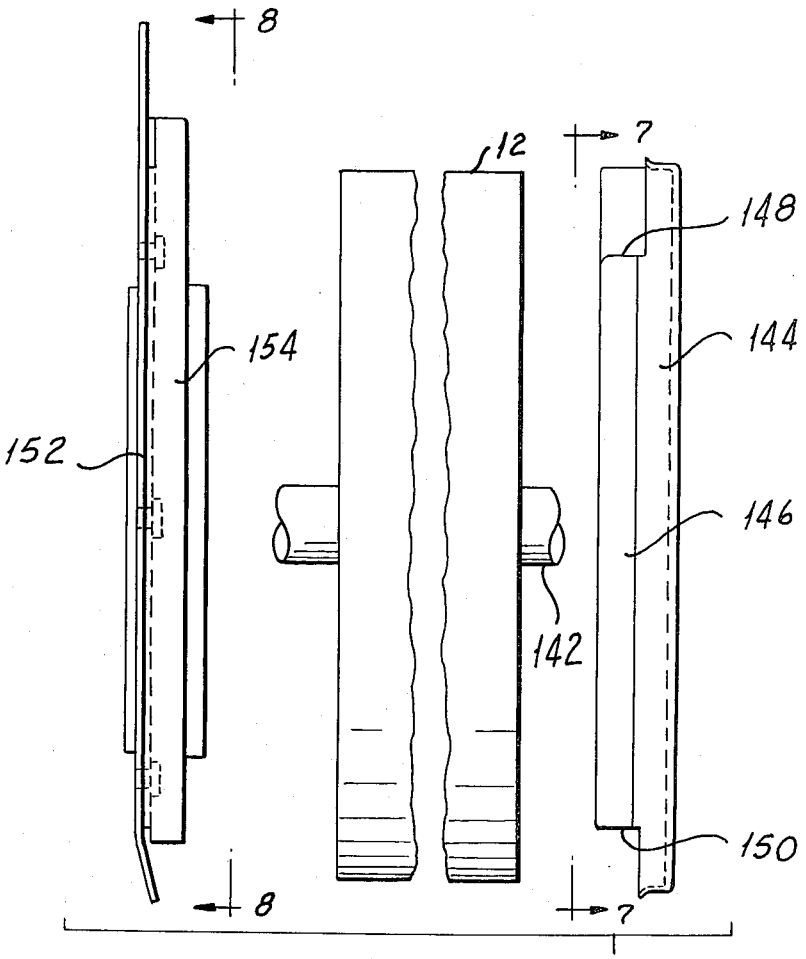
FIG. 6 is an elevation of the photoconductor drum and associated end plates of my liquid developer electrostatic copier for shipboard use.
Figure 7:
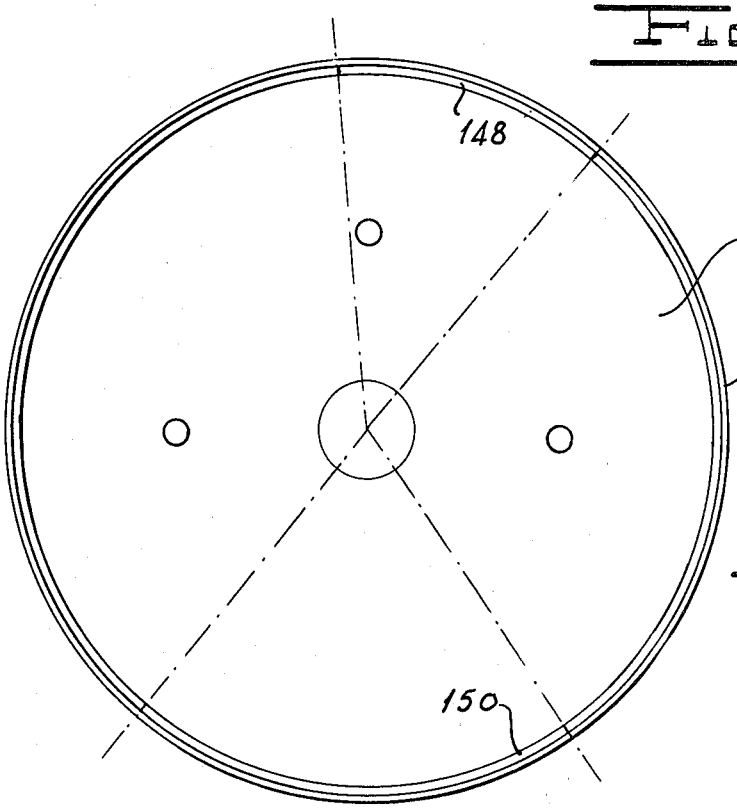
FIG. 7 is an elevation of one of the drum end plates of my liquid developer electrostatic copier taken along the line 7—7 of FIG. 6.

Referring now to FIGS. 6 to 8, drum 12 is supported on a shaft 142. I provide the drum at the front thereof with a stationary anti-splash plate 144 having a peripheral flange 146 which extends over the front end of the drum. This plate and the flange 146 serve to control the flow of liquid from the drum toward the front of the machine. It will be appreciated that the flange 146 is cut out at 148 to accommodate the cleaning system of the machine. A second cut out 150 at the bottom of the flange 146 accommodates the applicator electrode 18. Similarly, I provide a fluid flow control plate indicated generally by the reference character 152 at the rear of the machine and which is secured to an existing stationary plate 155 at the back of the machine. Plate 152 has a peripheral flange 154 which extends over the rear end of the drum to control the flow of fluid off the rear of the drum. As is the case with the flange 144, flange 154 is discontinuous in the region of the cleaning system and in the region of the electrode 18. Plate 155 and its associated construction is illustrated in U.S. Pat. No. 4,018,524.

Referring again to FIGS. 2 and 3, my copying machine for shipboard use includes a liquid level float 156 disposed in a housing 158 within the well portion of the tank 60. Housing 158 is open at the top and at the bottom to admit the developing liquid therein. It serves as a guide for the float 156. A baffle plate 160 extending downwardly from the bottom of the housing 90 supports one side of the float housing 158. This baffle plate inhibits such movement of the liquid developer as might give a false indication of a low liquid level. A rod 162 extends upwardly from the float 156 through a guide 164 in the bottom of housing 90 to an off-set 166 which connects the rod 162 to a rod 168 extending upwardly to guides 170 and 172 out of the tank 60 to a point at which carries a pin 174 which engages an arm 176 supported on a pivot pin 178 carried by a bracket 180. The empty signal switch 182 has a shaft 184 carrying a wire 186. When the level of liquid in the well portion of the tank 60 drops to a predetermined low level, float 156 moves downwardly until pin 174 pivots arm 176 to a sufficient distance to rotate switch shaft 184 through the medium of wire 186 sufficiently to close the switch to indicate that additional diluent should be added.

I provide respective rubber plates 188 at the ends of the blade 42 for ensuring that any liquid flowing laterally of the drum as the vessel pitches does not spill out of the machine but is directed downwardly back into the tank 60.

Figure 9:
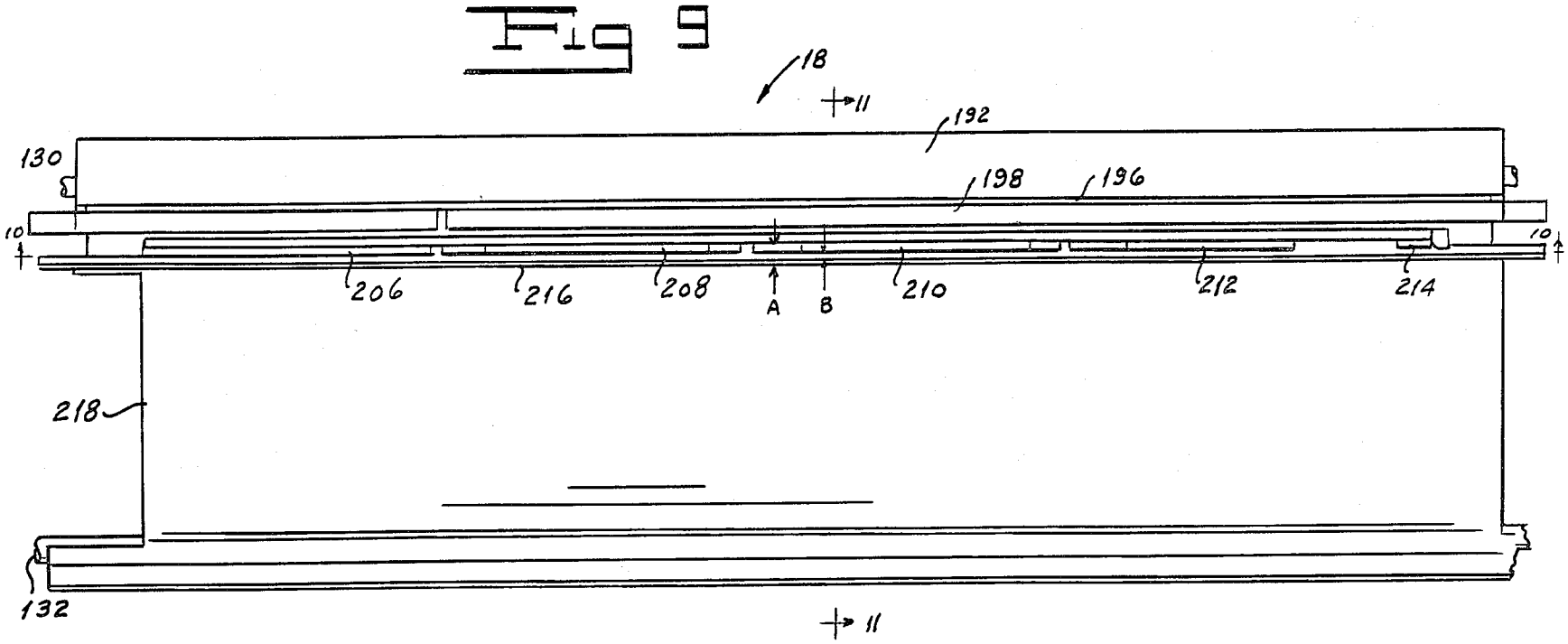
FIG. 9 is a top plan of the developer applicator assembly of my liquid developer electrostatic copier for shipboard use.
Figure 10:
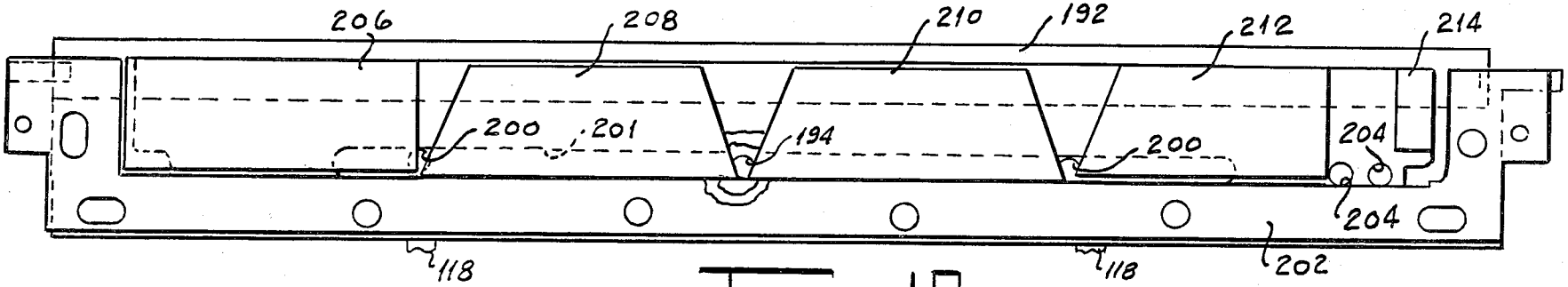
FIG. 10 is an elevation of a portion of the developer applicator assembly of my liquid developer electrostatic copier for shipboard use, taken along the line 10—10 of FIG. 9.
Figure 11:
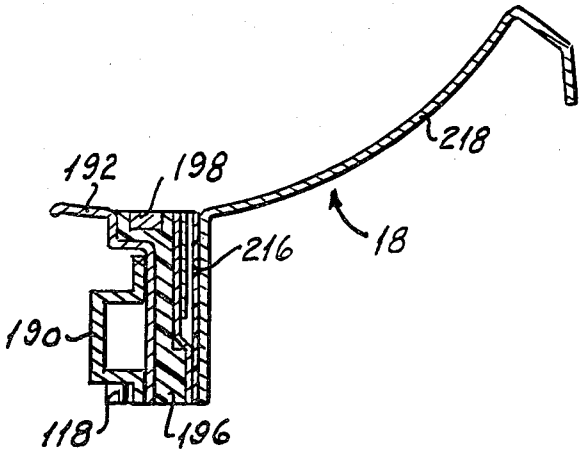
FIG. 11 is a sectional view of the developer applicator assembly of my liquid developer electrostatic copier for shipboard use taken along the line 11—11 of FIG. 9.

Referring now to FIGS. 9 to 11, the developer applicator assembly 18 includes a metal manifold 190 supplied with liquid developer through one or more inlets 118. A leading developer applicator portion 192 with reference to the direction of rotation of the drum is provided with holes 194, through which developer flows to the remainder of the applicator assembly. A sensing electrode support member 196 formed of any suitable material, such for example as an appropriate plastic supports the sensing electrode 198. Distributor holes 200 in the body of support 196 permit developer to flow therethrough. A guard plate 202 has a slot 201 and holes 204 permitting the flow of developer into a space between the plate and an insulator member 216 separating the plate 202 from the main applicator and developer electrode 218. It will be appreciated that there are two holes 200 which register with holes 204 and three holes 200 which register with slot 201. Moreover, there are holes 194 which register with all holes 200. In the applicator system of the copier over which my assembly represents an improvement, a space indicated by the arrows A in FIG. 9 is formed between plate 202 and the inboard surface of the downwardly extending portion of electrode 218, into which developer liquid flows across substantially the entire width of the applicator system. In my arrangement, however, I extend the insulating strip 216 upwardly to the top of the downwardly extending portion of the electrode 218. In addition, I secure a plurality of filler pieces 206, 208, 210, 212, and 214 to the upper portion of the plate 202 by any suitable means, such for example as by soldering, or the like. These fillers and the upwardly extending portion of the insulator 216 reduce the width of the gap through which developer flows to a distance indicated by the arrows B in FIG. 9. The entire developer assembly is held together by any suitable means, such for example as by screws (not shown).

The addition of the filler and the extension of the insulator 216 so control the flow of toner that it exits over the entire length of the slit. That is to say, given the toner pump pressure and flow rate, when the machine is tilted fore and aft considering the axis of the drum to extend in that direction, my fillers and extended insulator direct return flow to a few selected openings and so restrict the flow as to permit of full page copying, even with the machine tilted as much as 25° from the horizontal in a fore and aft direction. This flow control is governed by the shape of the fillers with relatively wide spaces between the edges of adjacent filters at the top of the slit, but only relatively narrow regions adjacent to the bottom thereof.

It will be seen that I have accomplished the objects of my invention. I have provided a liquid developer electrostatic copier which is especially adapted for use aboard ship. Liquid developer will not spill out of my copier even under relatively extreme deviation of the copier from the horizontal. My copier makes good copies even under relatively severe conditions of tilt. My copier is protected against damage and spilling as a result of shock where, for example, the copier is in use on a naval vessel, whereon guns are fired.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a liquid developer electrostatic copier for shipboard use, apparatus including in combination a liquid developer tank having an upper portion and a lower well portion extending downwardly from said upper portion, said well portion adapted to be filled to a predetermined level when a full charge of developer liquid is in said copier, a pump motor housing in said tank above said level, a splash plate extending over the top of said tank around the periphery thereof for inhibiting spilling of said liquid from said tank, a photoconductive drum disposed above said tank, a developer applicator member disposed between said tank and said drum, an opening in said splash plate below said applicator member, means forming a diluent inlet funnel adjacent to one end of said opening, a first baffle plate extending into said tank adjacent to said inlet funnel to inhibit movement of liquid out of said tank through said funnel, means forming a seal with said applicator member adjacent to the other end of said opening, respective liquid control end plates associated with said drum, each of said end plates having a peripheral flange extending axially toward said drum for receiving the corresponding drum end to direct liquid from said drum toward said opening, a cleaning blade in engagement with said drum, plates at the ends of said blade for directing liquid toward said opening, means extending into said well to inhibit free movement of fluid therein, a guide housing on said baffle means, a float within said guide housing and shock absorbing mounting means for supporting said apparatus.

2. In a liquid developer electrostatic copier for shipboard use, said copier having a photoconductor drum, apparatus including in combination a liquid developer tank having an upper portion and a lower well portion extending downwardly from said upper portion, said well portion adapted to be filled to a predetermined level below said upper portion when a full charge of developer liquid is in said machine, a pump motor housing in said tank above said level, a splash plate extending over the top of the upper portion of said tank around the periphery thereof for inhibiting spilling of said liquid from said tank, an opening in said splash plate below said drum, respective liquid control end plates associated with said drum, each of said end plates having a flange directed axially of the drum to receive an end thereof to direct liquid from said drum to said opening, each of said flanges extending around a major portion of the periphery of the drum and portion received thereby.

3. In a liquid developer electrostatic copier for shipboard use, apparatus including in combination a liquid developer tank having an upper portion and a lower well portion extending downwardly from said upper portion, said well portion adapted to be filled to a predetermined level when a full charge of developer liquid is in said copier, a pump motor housing in said tank above said level, a splash plate extending over the top of said tank around the periphery thereof for inhibiting spilling of said liquid from said tank, a photoconductive drum disposed above said tank, a developer applicator member disposed between said tank and said drum, an opening in said splash plate below said applicator member, means forming a diluent inlet funnel adjacent to one end of said opening, a first baffle plate extending into said tank adjacent to said inlet funnel to inhibit movement of liquid out of said tank through said funnel, means forming a seal with said applicator member adjacent to the other end of said opening, respective liquid control end plates associated with said drum, each of said end plates having a peripheral flange extending axially toward said drum for receiving the corresponding drum end to direct liquid from said drum toward said opening, a cleaning blade in engagement with said drum, plates at the ends of said blade for directing liquid toward said opening, means extending into said well to inhibit free movement of fluid therein, a guide housing on said baffle means, a float within said guide housing, said developer applicator including means forming a slit extending axially of said drum, means for supplying liquid developer to said slit, and filler means in said slit for controlling the flow of developer in said slit under conditions of tilt of the machine around an axis perpendicular to the drum axis to facilitate copying under said conditions of tilt.

4. In a liquid developer electrostatic copier for shipboard use, apparatus including a drum having an axis of rotation and adapted to receive a latent electrostatic image to be developed, a developer applicator for applying developer to said drum over an area thereof, said applicator forming a narrow elongated trough having a bottom and a mouth opening toward said drum, the length of said trough extending in the direction of said drum axis, means for supplying developer liquid to the bottom of said trough, and a plurality of filler elements disposed in said trough at spaced locations along the length thereof for controlling the flow of developer liquid therein to facilitate copying when said machine tilts around an axis perpendicular to the drum axis.

5. Apparatus as in claim 4 in which one of said filler elements extends from said mouth to a location closely spaced from said bottom.

6. Apparatus as in claim 4 in which one of said elements extends from a location closely spaced from said mouth to said bottom.

7. Apparatus as in claim 4 in which one of said elements extends from a location closely spaced from said bottom to said mouth and in which another of said elements extends from a location closely adjacent to said mouth to said bottom.

8. Apparatus as in claim 4 in which a pair of adjacent filler elements are so shaped as to have relatively remote edges adjacent to the mouth of said trough and relatively adjacent edges adjacent to the bottom of the trough.

9. Apparatus as in claim 4 in which said means for supplying developer liquid comprises means forming an inlet port at the bottom of said trough leading into the space between a pair of adjacent filler elements.

* * * * *